United States Patent [19]

Petkidis

[11] 4,345,358

[45] Aug. 24, 1982

[54] METHOD OF AND APPARATUS FOR MANUFACTURING PLOWSHARES

[76] Inventor: Dmetrios Petkidis, Protokklissi Soufli Ebrou, Greece

[21] Appl. No.: 120,621

[22] Filed: Feb. 11, 1980

[51] Int. Cl.[3] ..... B21H 7/06

[52] U.S. Cl. ..... 29/14; 72/214; 76/101 R

[58] Field of Search ..... 29/14; 72/214, 215, 72/220, 381, 400, 401; 76/101 R

[56] References Cited

U.S. PATENT DOCUMENTS

| | | | |
|---|---|---|---|
| 195,627 | 9/1877 | Meikie | 29/14 |
| 1,045,022 | 11/1912 | Hauberg | 72/220 |
| 3,792,602 | 2/1974 | Fukuda | 72/220 |
| 4,004,442 | 1/1977 | Strelechenko et al. | 72/214 |

FOREIGN PATENT DOCUMENTS

| | | | |
|---|---|---|---|
| 136458 | 7/1952 | Sweden | 72/215 |

*Primary Examiner*—R. L. Spruill
*Assistant Examiner*—K. Y. Lin
*Attorney, Agent, or Firm*—Harding, Earley, Follmer & Frailey

[57] ABSTRACT

An improved method of and apparatus for manufacturing plowshares that enables the plowshare bending and shaping operations to be performed with precision in a succession of reciprocal movements while minimizing the need for preforming or treatment of the material from which the plowshare is made prior to placement in the plowshare machine, which method and apparatus is further characterized by a capability of working sheet material of different thicknesses, and which utilizes hydraulic power cylinders.

2 Claims, 17 Drawing Figures

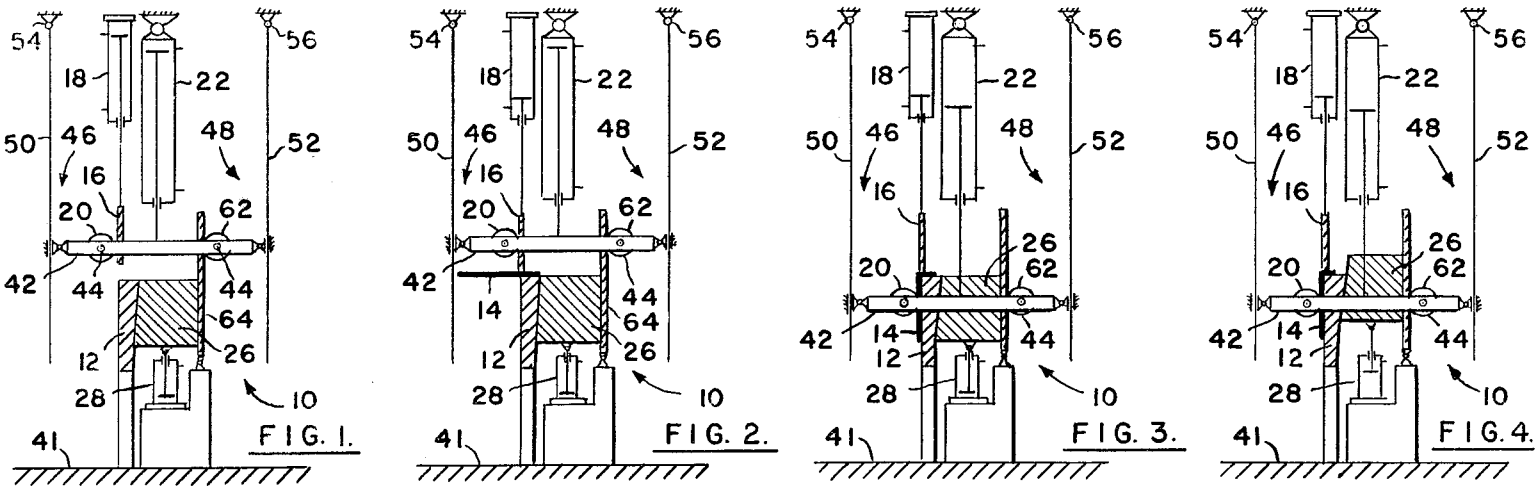
FIG. 1.
FIG. 2.
FIG. 3.
FIG. 4.
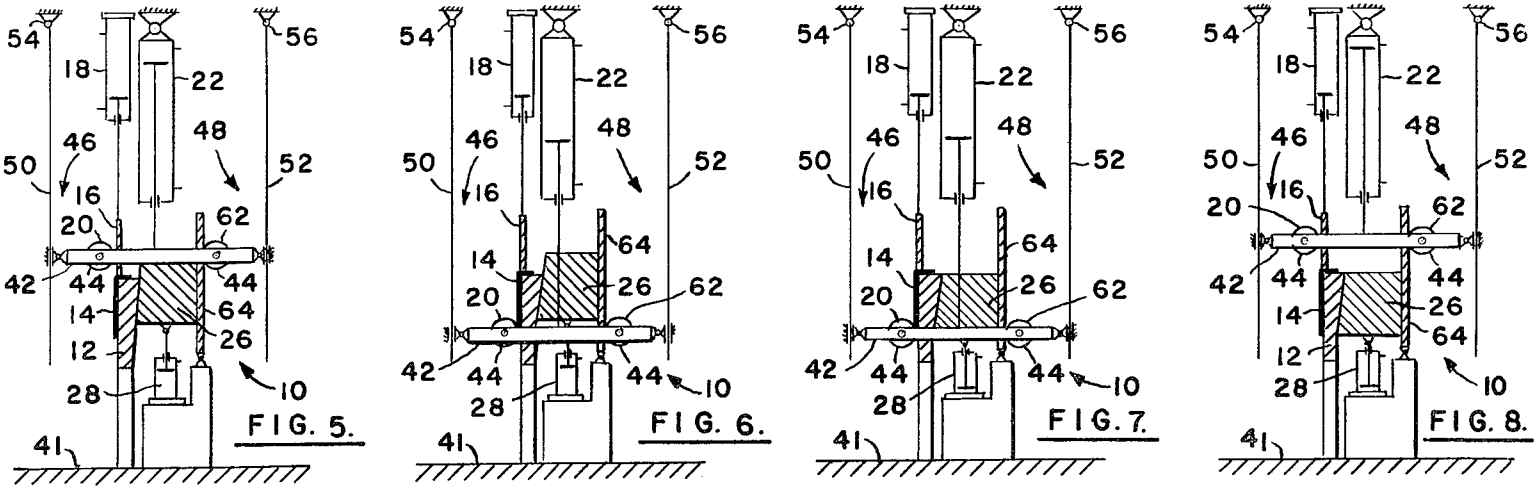
FIG. 5.
FIG. 6.
FIG. 7.
FIG. 8.

METHOD OF AND APPARATUS FOR MANUFACTURING PLOWSHARES

BACKGROUND OF THE INVENTION

1. Field of the Invention

This invention relates to a new and improved method of and apparatus for making a plowshare. A plowshare is the irregularly shaped part of a moldboard plow that is provided to cut the furrow slice at the bottom and side, and which includes a point that penetrates the soil first, a horizontal cutting edge, and an outside corner. Usually a plowshare is made of steel or chilled iron.

2. Description of the Prior Art

Machines for assisting blacksmiths and other mechanics in the shaping of and manufacture of plowshares have long been known in the prior art, several such machines being disclosed in the following U.S. Pat. Nos:

125,908; D. H. Rowe; Apr. 23, 1972

189,150; C. H. Thompson; Apr. 3, 1977

195,627; T. Meikle; Sept. 25, 1977

2,147,882; E. N. Childs; Feb. 21, 1939

As disclosed in U.S. Pat. Nos. 189,150 and 2,147,882, separately cut and heated metal blanks are attached to each other, being placed in several dies in which they are welded together, thereby forming a plowshare. In U.S. Pat. No. 125,908, a notched metal plate with a narrow flange is first prepared, then heated and introduced between upper and lower dies, which, at one blow of the upper die, produces a plowshare. U.S. Pat. No. 195,627 discloses a bending machine for making frog-plates for plows. The machine includes a stationary form or former that is cut in the required shape and a movable die that are brought together with a metal blank placed on edge between them. This makes the blank assume the shape of the form. A roll is then passed has the capability of working metal blanks of different thicknesses into plowshares.

A further object of the invention is to provide an improved machine for manufacturing plowshares that employs hydraulic power cylinders for actuating the roll and form relatively to each other in effecting the working of the blank into a plowshare.

A further object of the invention is to provide such a machine that is ruggedly constructed according to engineering requirements thereby to permit day-in and day-out repetitive use.

In accomplishing the foregoing and other objectives of the present invention, there is provided a machine or press for manufacturing plowshares that utilizes three double action hydraulic cylinders, an expulsion roll, a resistance roll, and a form. The sheet metal or other material comprising the blank that is to be formed into a plowshare, for convenience termed the "object", is preheated in a furnace to a suitably high temperature. This enables the object to be operated upon or "worked" without changing the crystalline structure thereof. The object is placed in clamping relation with the form and is operated upon by the expulsion roll and the form in a sequence of reciprocatory movements of the expulsion roll relatively to the form and thereby made to take the final shape and angle required for the plowshare.

The machine according to the present invention has the capability of working with metal sheets of different thicknesses. The form has incorporated on its surface, a generally planar surface, the shape of the plowshare but in its inverse or negative configuration. The expulsion roll also has the shape of the plowshare incorporated in its exterior circumferential or rolling surface, as by being cut or dug therein, and, as noted, is arranged for reciprocatory movement with respect to the surface of the form. With the object placed between the expulsion roll and the form, and allowing rotative as well as recip- "loaded" depending portion of the object to a position above and out of contact with the object;

FIG. 6 is a similar view showing the expulsion cylinder again energizing downwardly toward its lowermost or bottom position, with the wedge maintained in its loading or upper position;

FIG. 7 is a similar view showing the wedge cylinder energized toward its bottom position, pulling the wedge down and relieving the pressure or loading against the object;

FIG. 8 is a similar view showing the expulsion cylinder energizing toward its initial starting upper position;

DESCRIPTION OF THE STRUCTURE AND OPERATION OF THE PREFERRED EMBODIMENT

FIGS. 1 through 8 are schematic diagrams that illustrate the general arrangement and operation of the plowshare machine according to the present invention.

Figure 9:
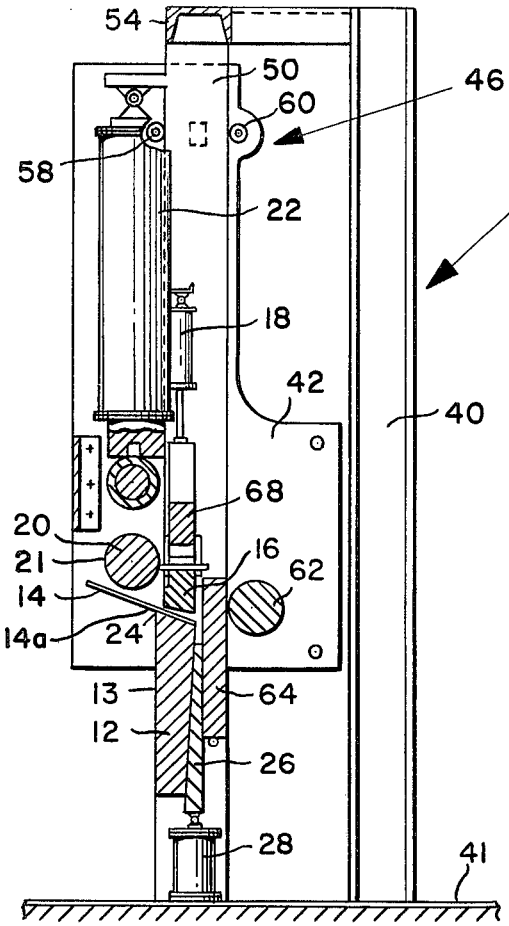
FIG. 9 is a side elevation of the machine with parts broken away and other parts in cross section taken along the lines 9—9 of FIG. 10.
Figure 10:
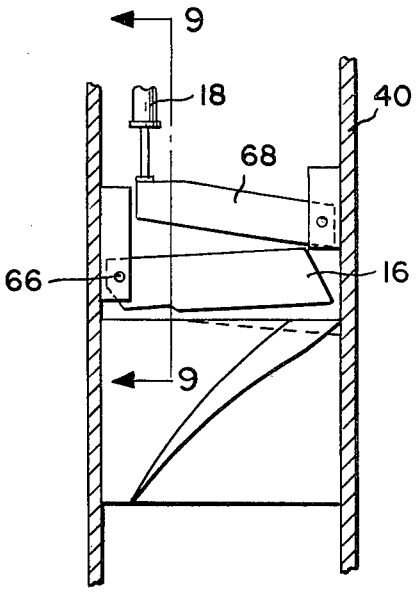
FIG. 10 is a partial front elevational view of the machine with parts broken away to show the mechanism for clamping the object.
Figure 13:
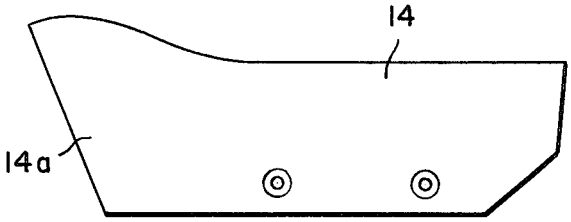
FIG. 13 is a plan view illustrating the shape of the original blank or object.
Figure 11:
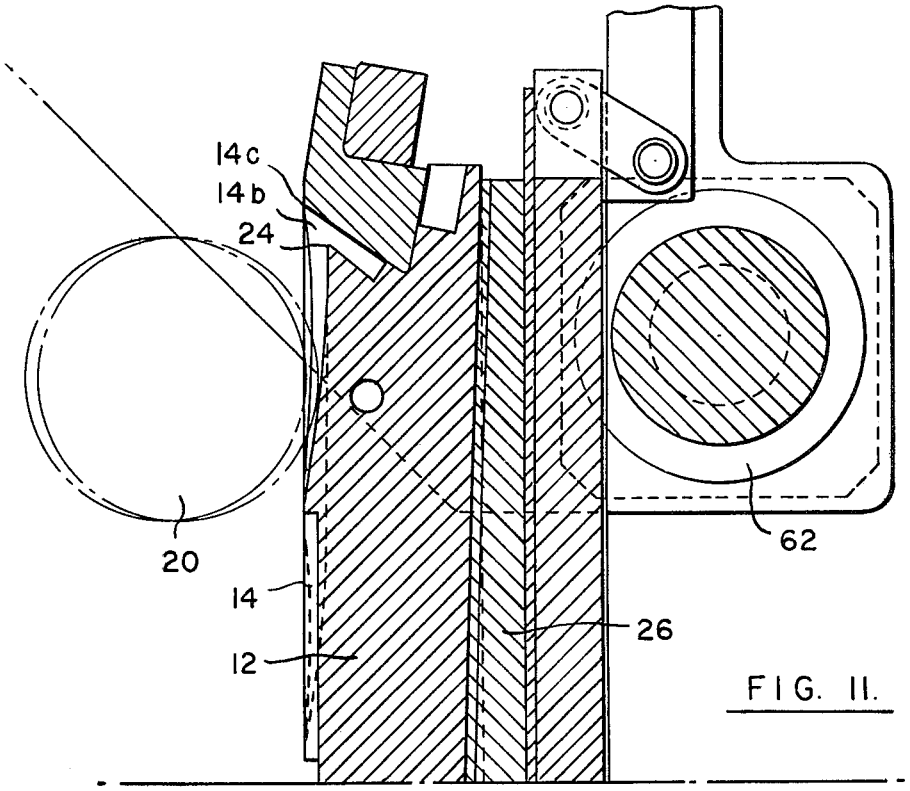
FIGS. 11 and 12 are partial side elevational and front views, respectively, showing the plowshare shaping characterization of the form and the expulsion roll.
Figure 14:
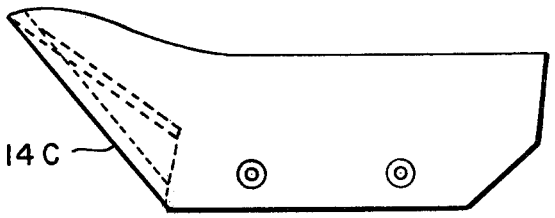
FIGS. 14, 15 and 16 are bottom, leading edge side and trailing edge side views of the completed plowshare.

The plowshare machine or press is indicated at 10, and comprises a form 12 on which a preheated metal blank 14, as illustrated in FIG. 13 and for convenience, termed the object, is placed. Blank 14 is adapted to be held against the top edge of form 12, being clamped thereto, by a lever 16, as shown in FIGS. 9 and 10, lever 16 being actuated by a suitably mounted hydraulic cylinder 18. Blank 14 is clamped at an angle between form 12 and lever 16 with corner 14*a* thereof flush with an edge 24 of form 12. An expulsion roll indicated at 20 is adapted for reciprocatory movement, upwardly and downwardly with respect to form 12, by a suitably mounted double action expulsion hydraulic cylinder 22. When moved downwardly, as seen in FIGS. 3 and 9, the expulsion roll 20 is forced into firm engagement with blank 14 and thereby form 12, by means described hereinafter, to brake a triangular shaped portion of the object 14 at an angle around the upper edge 24 of form 12. Edge 24 of form 12, as seen in FIGS. 9 and 11, is a sharp, acute angle edge. The portion 14*b* of blank 14 that is bent, as seen in FIGS. 11 and 14, is sharp and acute, the edge 14*c* thereof being straight. This brake angle is very important for it is the guide for the plowshare and is used in turning over the earth in plowing.

As described further hereinafter by reference to FIGS. 11 and 12, the circumferential surface 21 of expulsion roll 20 and the cooperating surface 13 of form 12 are both characterized having cut or dug in them, in inverse or negative configuration, the shape of the plowshare.

A wedge indicated at 26 is also adapted for reciprocatory upward and downward movement from a bottom or retracted position with respect to form 12 by a double action suitably mounted hydraulic cylinder 28. When moved upwards, wedge 26 exerts pressure or force against form 12 to push the form 12 and the object 14 toward the left, as seen in FIGS. 4 and 9. With the object 14 thus positioned, the expulsion roll 20 is moved upwardly, as shown in FIG. 5, to make the angle of the plowshare an acute and straight angle. This corrects for any tendency for the angle to be rounded or curved, which is undesirable.

Figure 15:
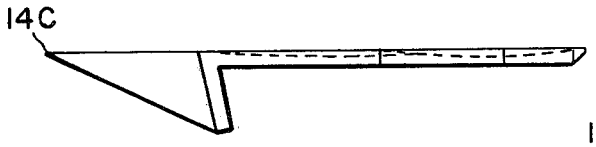
Figure 16:
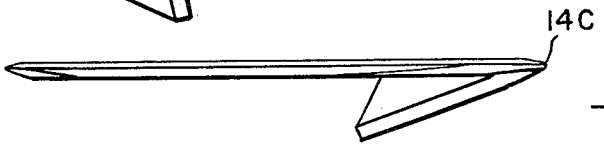

In the further sequence of the operation of the plowshare machine 10, the expulsion roll 20 is again moved downwardly by the hydraulic cylinder 22, as shown in FIG. 6; the wedge 26 is moved downwardly to its retracted position, as shown in FIG. 7; and the expulsion roll 20 is moved upwardly, as shown in FIG. 8, toward its initial starting upward position. The hydraulic holding cylinder 18 is then energized toward its upper position, releasing the clamping action of lever 16 and thereby allowing the object 14, now a completed plowshare as illustrated in FIGS. 14–16, to be removed from the machine 10. The machine 10 is now at the end cycle and the three hydraulic cylinders 18, 22 and 28 are in the positions indicated in FIG. 1.

It is noted that, due to the high temperatures involved in the operation, the form 12 desirably is equipped with a cooling system (not shown) to the end of avoiding dangerous expansion.

Figure 17:
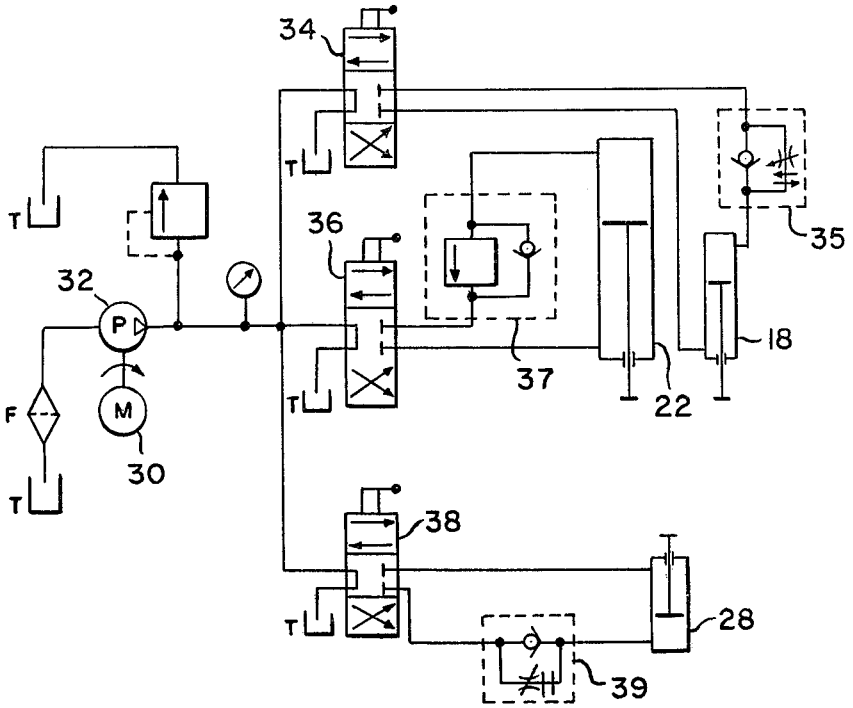
FIG. 17 is a diagram of the hydraulic circuit of the machine.

The movements of the machine or press 10, as indicated, are effected by a simple hydraulic system which, as shown in the schematic diagram of the hydraulic circuit of FIG. 17, includes one electric motor, indicated at 30, one hydraulic pump (with gears) indicated at 32, the three previously mentioned hydraulic cylinders 18, 22 and 28, and three valve units indicated at 34, 36 and 38 for controlling, respectively, the actuation of the hydrauic cylinders 18, 22 and 28. Flow control valves with check indicated at 35, 37 and 39 are provided in association with valve units 34, 36 and 38, respectively.

As shown in FIG. 9, form 12 is rigidly supported by a non-moving, that is a stationary, frame 40 that is shown as being upright, rigidly supported on a base 41. Frame 40, however, may be horizontally disposed, if desired. The expulsion roll 20 is carried by a movable frame 42, being connected to frame 42 by suitable bearing means (not shown) in frame 42 and in which journals 44 as indicated in FIG. 1 on the ends of roll 20 revolve. This structure provides for rotation of the expulsion roll 20 as it is reciprocated, that is, moved up and down with frame 42 relatively to form 12. Suitable gearing, not shown, is provided in association with expulsion 20 and stationary frame 40 whereby a precise synchronized, angular relationship is maintained between the rotation of expulsion roll 20 and its position along form 12 during such reciprocatory movement.

Frame 42 is guided for reciprocatory movement by guide means indicated at 46 and 48 and that includes opposed depending guide bars 50 and 52 that are supported by means of suitable suspension means indicated at 54 and 56 respectively, from an upper position, as seen in the drawing, of non-moving frame 40. Guide means 46, as shown in FIG. 9, includes a pair of rollers 58 and 60 that are mounted for rotation in movable frame 42, each roller 58 and 60 engaging a respective one of the opposed sides of the associated guide bar 50. A similar pair of rollers, not shown in FIG. 9 but indicated generally in FIGS. 1–8, is provided for guide means 52, being arranged in cooperative relation with the guide bar 52. At the lower end of movable frame 42, mounted for rotation thereon in transversely spaced relation to the expulsion roll 20, is a resistance roller 62. Resistance roller 62 is disposed in rolling engagement with a plate 64 that is rigidly mounted on frame 40 in parallel spaced relation to the form 12, the wedge 26 being located between form 12 and plate 64. The surfaces of form 12 and wedge 26 that are in engagement desirably slope in complementary manner so that as wedge 26 is moved upwardly as previously described, the plane of the characterized surface 13 of form 12 that engages the object 14 does not deviate from the vertical, as shown, although a transverse shift thereof to the left occurs to push the object to the left against the opposing force of the expulsion roll 20.

Lever 16 which is employed to clamp the object 14 to the form 12 is connected at one end to one side of the stationary frame 40 by pivot means 66, as seen in FIG. 10, lever 16 being suitably biased upwardly, by means not shown, to allow ready placement of the object 14 for clamping on form 12. The other end of lever 16 is adapted to be engaged by a second lever 68 that is pivoted to the opposite side of frame 40, the other end of lever 68 being connected to the movable stem of the hydraulic cylinder 18. Desirably, as shown in FIG. 10, the position of engagement of levers 16 and 68 is selected so as to provide a desirable mechanical advantage for efficient operation in the clamping of the object 14 to the form 12.

Figure 12:
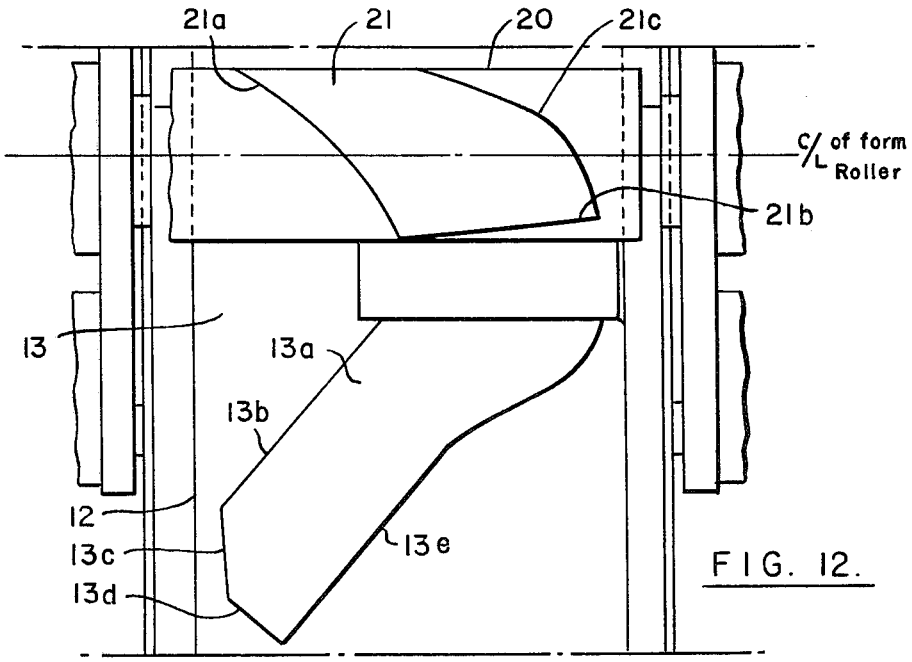

Form 12, as previously noted, and as shown in FIGS. 11 and 12, has in its surface, indicated at 13, the shape 13*a* of the plowshare, although in inverse or negative configuration, being cut deepest along the left edges 13*b*, 13*c*, and 13*d* where the plowshare thickness is to be greatest for strength and tapering along a generally convex curve to an edge 13*e* of minimum depth where a thinner edge for the plowshare is desired. The expulsion roll also has the shape of the plowshare dug into it, as shown in FIGS. 11 and 12, the left edge 21*a* and lower edge 21*b* being deepest and gradually tapering to the full circumferential surface of roll 20 substantially at the right edge 21*c*.

The cooperative synchronized angular relationship of the form 12 and the expulsion roll 20, as previously described, is such that with the reciprocal movement of the expulsion roll 20 along with the rotation of the expulsion roll 20, with the object 14 placed between them, the object 14 is forced to take the shape that is on the surface 13 of form 12 and on the surface of the expulsion roll 20. It is noted that during such reciprocation of expulsion roll 20 relatively to the surface 13 of form 12, the edges 21*a* and 21*c* of roll 20 lie adjacent the edges 13*b* and 13*c* respectively of the surface 13 of form 12.

Additionally, when in the sequence of the operation of the machine 10, as previously described, the wedge 26 is moved upwardly to push the object 14 to the left and the expulsion roll 20 is moved upwardly and downwardly, as seen in FIGS. 5 and 6, respectively, the object 14 is also worked to make the angle of the plowshare acute and straight, as seen in the illustrations of FIGS. 14 and 15. It is noted that the machine 10 may be made to accommodate objects of different thicknesses by moving the initial position of wedge 26 up and down.

The sequence of the manual operation of the plowshare machine 10 according to the present invention may be summarized by reference to FIGS. 1–10 and 17, as follows:

1. Load hot blank or object 14 into the machine 10.
2. Open valve 35 to energize hydraulic cylinder 18 to move the clamp lever 16 down to hold the object 14 in place and start sequence.
3. Open valve 37 to energize hydraulic cylinder 22 to cause expulsion roll 20 to stroke downward approximately half way (for example 12½") thereby to bend over a triangular shaped portion of the upper edge of the object 14 and then stop.
4. Open valve 39 to energize hydraulic cylinder 28 to cause wedge 26 to stroke upward thereby to move form 12 and object 14 to the left, as seen in the drawings, to force the expulsion roll 20 to finish working the object 14 to the required thickness.
5. Close valve 37 to energize the hydraulic cylinder 22 to move the expulsion roll 20 upward thereby to sharpen the outside corner of the object 14.
6. Open valve 37 to energize the hydraulic cylinder 22 to cause the expulsion roll 20 to move its full stroke (for example, 25") downward and finish the roll portion of the object 14 shaping.
7. Close valve 37 to energize the hydraulic cylinder 22 to cause the expulsion roll 20 to move upwards its full stroke to its initial starting position.
8. Close valve 35 to energize hydraulic cylinder 18 to cause lever 16 to lift upwards and thereby release the object 14, now a completed plowshare, for removal.

Thus, there has been provided according to the present invention an improved method of and apparatus for manufacturing plowshares that enables the plowshare bending and shaping operations to be performed with precision in a succession of reciprocal movements while minimizing the need for preforming or treatment of the material from which the plowshare is made prior to placement in the plowshare machine, which method and apparatus is further characterized by a capability of working sheet material of different thicknesses, and which utilizes hydraulic power cylinders.

I claim:

1. A method for forming a plowshare comprising the steps of placing a preheated metal blank so that a first portion of its rests on the top end of a form and a second portion extends away from the top end of the form, the surface of the form having the shape of plowshare to be formed, clamping said first portion in place so that the second portion extends at an angle which is above the horizontal, braking the blank around an edge of the form so that said second portion of the blank forms an acute angle with said first portion by moving a roll downwardly to bend the second portion against the form, the surface of the roll also having the shape of plowshare to be formed, moving the blank toward the roll by moving upwardly a wedge that is in contact with the form, moving the roll upwardly to sharpen the acute angle between the first and second portions of the blank, moving the roll downwardly to complete the making of the plowshare, moving the wedge downwardly to allow the form to move back to its original position, moving the roll upwardly to its original position, and unclamping said first portion of the blank to release the plowshare from the form.

2. A machine for forming a plowshare comprising means including a form for receiving a preheated metal blank so that a first portion of it rests on the top end of the form and a second portion extends away from the top end of the form, the surface of the form having the shape of plowshare to be formed, means for clamping said first portion in place so that the second portion extends at an angle which is above the horizontal, means for braking the blank around an edge of the form so that said second portion of the blank forms an acute angle with said first portion by moving a roll downwardly to bend the second portion against the form, the surface of the roll also having the shape of plowshare to be formed, means for moving the blank toward the roll including a wedge that is moved upwardly in contact with the form to move the form toward the roll, means for moving the roll upwardly to sharpen the acute angle between the first and second portions of the blank, means for moving the roll downwardly to complete the making of the plowshare, means for moving the wedge downwardly to allow the form to move back to its original position, means for moving the roll upwardly to its original position, and means for unclamping said first portion of the blank to release the plowshare from the form.

* * * * *